US008341898B1

(12) United States Patent
Mizia et al.

(10) Patent No.: US 8,341,898 B1
(45) Date of Patent: Jan. 1, 2013

(54) MODULAR LOG ASSEMBLY SYSTEM

(75) Inventors: Richard Mizia, Deer River, MN (US); Charles Mizia, Deer River, MN (US)

(73) Assignee: Grand Log Homes LLC, Cohasset, MN (US)

( * ) Notice: Subject to any disclaimer, the term of this patent is extended or adjusted under 35 U.S.C. 154(b) by 0 days.

(21) Appl. No.: 13/173,319

(22) Filed: Jun. 30, 2011

(51) Int. Cl.
*E04B 1/10* (2006.01)

(52) U.S. Cl. ..... 52/233; 52/286

(58) Field of Classification Search ..... 52/233, 52/284, 286, 518, 519, 520, 536, 539, 541, 52/542, 554, 555
See application file for complete search history.

(56) References Cited

U.S. PATENT DOCUMENTS

| | | | | |
|---|---|---|---|---|
| 3,377,758 | A | 4/1968 | Witschnig | |
| 3,682,212 | A | 8/1972 | Brewer | |
| 4,012,876 | A * | 3/1977 | Grubbs | 52/233 |
| 4,279,108 | A | 7/1981 | Collister, Jr. | |
| 4,288,954 | A | 9/1981 | O'Donnell | |
| 4,305,238 | A | 12/1981 | Harward et al. | |
| 4,391,067 | A | 7/1983 | Frady et al. | |
| 4,433,519 | A | 2/1984 | Jenkins | |
| 4,567,701 | A | 2/1986 | Biggs et al. | |
| 4,627,204 | A | 12/1986 | Smith | |
| 4,640,069 | A | 2/1987 | Felser | |
| 4,777,773 | A | 10/1988 | Fry | |
| 4,967,526 | A | 11/1990 | Yost | |
| 5,167,103 | A | 12/1992 | Lindal et al. | |
| 5,181,358 | A | 1/1993 | Mead | |
| 5,253,458 | A | 10/1993 | Christian | |
| 5,265,390 | A | 11/1993 | Tanner | |
| 5,271,878 | A * | 12/1993 | Mizia et al. | 264/45.5 |
| 5,423,153 | A | 6/1995 | Woolems et al. | |
| 5,577,357 | A | 11/1996 | Civelli | |
| 5,586,422 | A | 12/1996 | Hoffner | |
| 5,735,099 | A | 4/1998 | Anderson | |
| 5,782,046 | A | 7/1998 | Karlsson | |
| 5,787,661 | A | 8/1998 | Sharp | |
| 5,878,542 | A | 3/1999 | Cornelius | |
| 5,881,786 | A | 3/1999 | Wilderman et al. | |
| 5,896,723 | A | 4/1999 | Sing | |
| 6,199,332 | B1 | 3/2001 | Ellson | |
| 6,363,672 | B1 | 4/2002 | Baker | |
| 6,408,580 | B1 | 6/2002 | Jurvis et al. | |
| 6,427,414 | B1 | 8/2002 | Wing | |
| 6,543,193 | B2 * | 4/2003 | Houseal | 52/233 |
| 6,647,687 | B2 | 11/2003 | Kern | |
| 6,786,015 | B2 | 9/2004 | Wilt | |
| 7,117,647 | B2 | 10/2006 | Clarke | |
| 2002/0129571 | A1 | 9/2002 | Jurvis et al. | |
| 2004/0111990 | A1 * | 6/2004 | Neff | 52/272 |
| 2004/0211136 | A1 | 10/2004 | Stanton | |
| 2005/0115177 | A1 * | 6/2005 | Morgenstern | 52/233 |
| 2006/0168904 | A1 * | 8/2006 | Muszynski | 52/233 |
| 2006/0248825 | A1 | 11/2006 | Garringer | |
| 2007/0163199 | A1 | 7/2007 | Imai et al. | |

(Continued)

*Primary Examiner* — Mark Wendell
(74) *Attorney, Agent, or Firm* — Dietz Law Office LLC

(57) ABSTRACT

An apparatus and method is described for applying a siding or facing to an internal or external surface of a wall, enclosure, or other building construction to simulate a solid debarked log wall construction that includes varying diameter non-uniform logs. The invention further pertains to a lightweight yet rigid assembly that closely resembles at least a portion of a solid debarked log and includes longitudinal segments that may be coupled together to a backing material to create a siding or facing that simulates the exterior of a log whose circumference may be varied.

22 Claims, 18 Drawing Sheets

U.S. PATENT DOCUMENTS

| | | | | |
|---|---|---|---|---|
| 2007/0245667 | A1 | 10/2007 | Clegg | |
| 2007/0294967 | A1* | 12/2007 | Posselt | 52/233 |
| 2008/0083177 | A1* | 4/2008 | Tiberi et al. | 52/233 |
| 2008/0282629 | A1 | 11/2008 | Cook et al. | |
| 2009/0151279 | A1* | 6/2009 | Perron | 52/233 |
| 2010/0043323 | A1 | 2/2010 | Wrightman | |
| 2010/0101169 | A1 | 4/2010 | Logan et al. | |
| 2010/0132296 | A1 | 6/2010 | Bootier et al. | |
| 2010/0139080 | A1 | 6/2010 | Baum, Jr. | |
| 2011/0078966 | A1* | 4/2011 | Herman | 52/233 |

* cited by examiner

MODULAR LOG ASSEMBLY SYSTEM

CROSS-REFERENCE TO RELATED APPLICATIONS

Not Applicable

FEDERAL SPONSORSHIP

Not Applicable

JOINT RESEARCH AGREEMENT

Not Applicable

TECHNICAL FIELD

This invention pertains generally to a siding or facing that may be applied to an internal or external surface of a wall, enclosure, or other building construction. More particularly, this invention pertains to a facing assembly that may be applied to a wall to simulate a solid debarked log wall construction that includes varying diameter non-uniform logs. The invention further pertains to a lightweight yet rigid assembly that closely resembles at least a portion of a solid debarked log in look, feel, wear, and other characteristics.

BACKGROUND

Natural log wall constructions typically utilize whole or solid logs with the outer bark and inner bark (cork cambium and secondary phloem) removed, leaving the sapwood layer of the log exposed. Although solid log buildings are quite authentic, they are often times unstable, difficult to install, and costly to maintain. The instability of larger logs manifests itself in shrinking, checking, twisting, warping, and inconsistent settling due to different drying patterns in the logs. Also, gable construction may require modification or additional structure to compensate for the instability of the solid logs and to provide a stable structural roof system as the building compresses and settles. Further, the weight of solid logs may require larger footings or other additional structural support. Additionally, the increased growth life of larger-diameter solid logs may affect the availability of the desired logs for construction. In order to maintain and preserve these logs a stain or varnish is often applied to the logs resulting in a distinctly recognizable surface.

Over the years many attempts have been made to provide a contoured siding material that simulates a solid debarked log wall construction. Generally, various sidings have previously been described to cover the interior or exterior walls of a budding which attempt to simulate a solid log wall construction.

One known prior siding system includes an exterior surface that attempts to simulate the exterior of the sapwood of a natural log by utilizing a veneer that is bent to simulate a curved exterior portion of a log. The veneer is typically thin and smooth, lacking the appearance of a debarked log surface. Veneers are commonly of the peeled, sliced, or sawn type (typically ⅛ inch thick) or may comprise a two layer veneer consisting of a sawn or sliced veneer and a rotary peeled veneer having a typical combined thickness of ¼ inch. This veneer 'skin' is laminated to an expanded polystyrene core, which in turn is laminated to a piece of oriented strand board. An additional film forming stain may be applied to the veneer to mitigate the effects of rain on the veneer. This type of veneer siding is described further in U.S. Pat. No. 5,271,878A.

Once a veneer siding of this type is applied to an exterior wall it has been observed that the log veneer siding surface temperatures may reach 165° F. Additionally, the thin veneer layer may be subjected to significant temperature swings. These changes in temperature may lead to premature degradation of the veneer layer including feathering or checking of the veneer. A further disadvantage of veneer siding is a limitation in available widths of the veneer. Manufacturing constraints typically limit the maximum width of a veneer resulting in a maximum length of siding in the range of 98 inches without a seam. Each seam or short length of siding may diminish the energy integrity of the building envelope and may increase a potential for moisture migration.

Other prior devices describe techniques for creating the appearance of a whole or complete log that require sides, a support positioned between the two sides to hold the sides in a spaced relation and insulation filling a void created between the two sides. The upper and lower portions of the simulated log include gaps or openings in the top and bottom sides of the log. Representative examples of these systems are described in U.S. Pat. Nos. 4,433,519A, 3,377,758 and 5,782,046A. Although the described "logs" apparently stack together to form a structural load-bearing wall, the supports are required to align vertically which may prove impractical during installation in the field.

SUMMARY

Embodiments according to aspects of the invention include a wall facing or siding apparatus or assembly for simulating a log wall construction. The facing includes at least first and second facing segments, a shim segment, and a backing. The first facing segment couples with the backing and the shim segment couples with both the second facing segment and the backing. The first and second facing segments may be aligned and contoured so that the outwardly facing surfaces of the first and second segments create an arching surface. The arc of this arching surface may be varied by coupling additional facing segments between the first and second facing segments. Insulation may be added to fill an internal void created between the first and second segments, shim and backing.

In an embodiment according to aspects of the invention at least first, second and third longitudinal facing segments are provided, wherein the second longitudinal facing segment is coupled between the first and third longitudinal facing segments, and the first longitudinal facing segment is coupled to a backing. A shim segment may couple to both the third longitudinal facing segment and the backing. The first, second and third longitudinal facing segments may be coupled and aligned to create an arching external and internal surface. The arc of this arching surface may be varied by coupling additional facing segments between the first and second or second and third facing segments or by eliminating segments. The coupling between the facing, shimming, and backing elements is preferably made by a generally tongue and groove joint.

The external surface may be further cut and shaped to closely resemble the surface left by a draw knife or debarking equipment. To further reduce a uniform appearance of the log assembly additional segments may be added to separate log assemblies to vary the external partial circumference of the varying log assemblies. Sufficient longitudinal segments may be coupled together to form a gapless circumferential external surface and an enclosed inner portion. The gapless circumferential surface forms a substantially cylindrical log assembly with an arching external surface. A cap may be engaged to the ends of the log assembly and concentric grooves may be scribed into the cap to create the appearance of growth rings.

Embodiments according to aspects of the invention may further provide a continuous solid back, a built in drip edge system on a lower portion of the facing, a tongue and groove fastening system having a primary adhesive surface that is not tangential to an adjacent outer surface joint, a high content bio-based insulation, a saddle-notch corner systems, lighter weight log assemblies capable of bearing truss loads, or foundation log facing assemblies.

The accompanying drawings, which are incorporated in and constitute a portion of this specification, illustrate embodiments of the invention and, together with the detailed description, serve to further explain the invention. The embodiments illustrated herein are presently preferred; however, it should be understood, that the invention is not limited to the precise arrangements and instrumentalities shown. For a fuller understanding of the nature and advantages of the invention, reference should be made to the detailed description in conjunction with the accompanying drawings.

DESCRIPTION OF THE DRAWINGS

In the various figures, which are not necessarily drawn to scale, like numerals throughout the figures identify substantially similar components.

DETAILED DESCRIPTION

Figure 1:
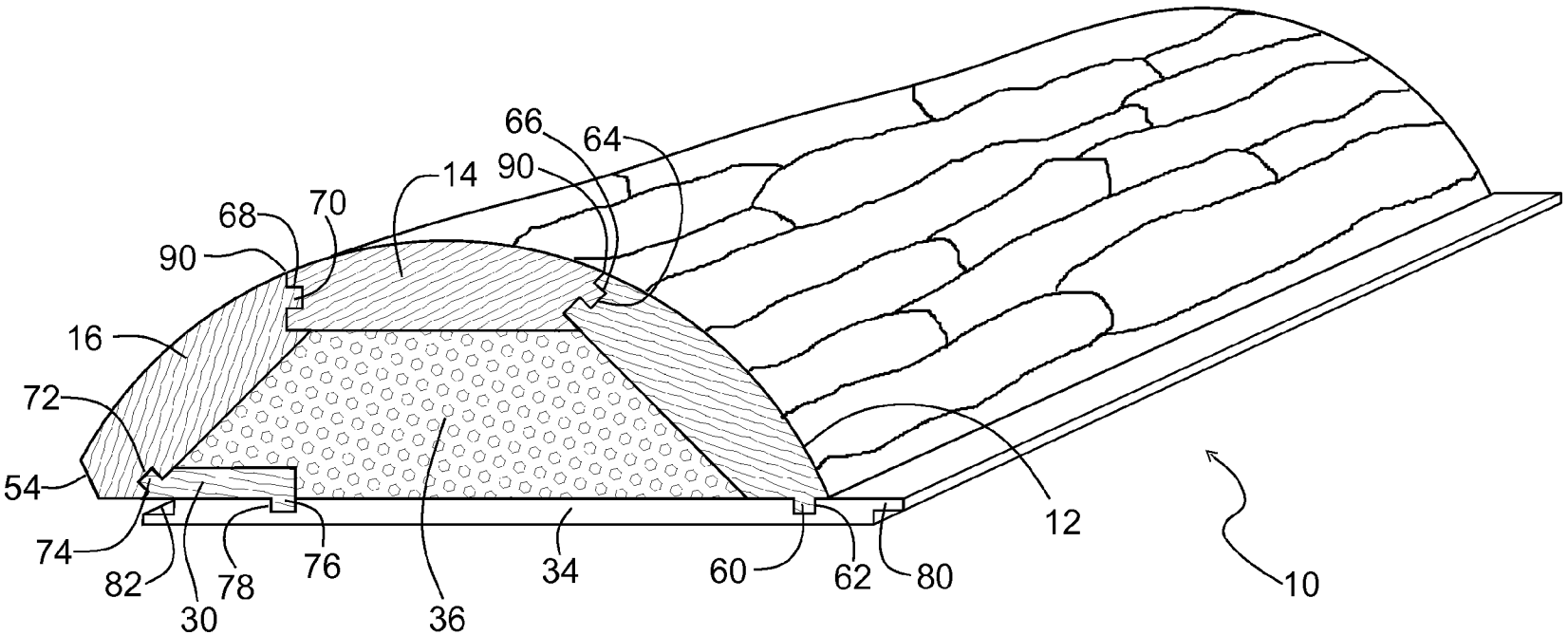
FIG. 1 is an end perspective view of a facing assembly or log siding member in accordance with an embodiment of the invention.

The following description provides detail of various embodiments of the invention, one or more examples of which are set forth below. Each of these embodiments are provided by way of explanation of the invention, and not intended to be a limitation of the invention. Further, those skilled in the art will appreciate that various modifications and variations may be made in the present invention without departing from the scope or spirit of the invention. By way of example, those skilled in the art will recognize that features illustrated or described as part of one embodiment, may be used in another embodiment to yield a still further embodiment. Thus, it is intended that the present invention also cover such modifications and variations that come within the scope of the appended claims and their equivalents.

The log assembly of the present invention includes longitudinal segments that are coupled together to create an external arching surface that may be coupled to a backing to form an approximately quarter round or half round log assembly or may include a sufficient number of segments to form a three quarters round or substantially cylindrical "log" assembly. Multiple log assemblies are stacked to create the appearance of a stacked log wall. An embodiment of the log assembly includes a spacer to create an appearance of chinking positioned between stacked logs. The log assembly of the present invention closely resembles a solid debarked log and the diameter may be varied to provide a siding or facing having non-uniform logs.

The log assembly may include shims and planar segments to create log assemblies suitable for use as a lower most base or foundation log or as a three quarter round log applied to a corner of a wall. The log assembly may also be used to create functional or decorative log trusses to support a roof structure. The log assembly may also be sawn to form staggered saddle notch corner assemblies having varied diameter logs to further simulate a solid log wall construction.

Traditional log wall constructions utilize debarked solid logs. When debarking with a draw knife or automated equipment the bark is removed to expose the sapwood. Numerous short, flat, and narrow surfaces are left in the sapwood as the bark is removed. This surface feature or texture creates a distinctively recognizable circumferential surface on the log. Thin veneered log siding is not thick enough to allow for a sculpturing of the veneer to replicate a debarked solid log. Further, other plastic, aluminum or cement based sidings may be molded to replicate the surface texture, however these materials do not take on stain, paint, or varnish that matches well the appearance of varnished or stained sapwood of solid debarked logs.

The longitudinal segments of the present invention are cut from a log and are thick enough to allow for modifying, scrapping or otherwise sculpting the outer surface to simulate the surface created from a draw knife or other debarking equipment. The longitudinal segments are also thick enough so that stain and varnish absorbs at a rate and to a depth that simulates well the staining or varnishing of the sapwood on a solid log.

Generally, timber is cut at a sawmill using one or more sawing patterns including: live or through and through sawing, cant sawing, sawing for grade, sawing for radial grain (sometimes referred to as quarter sawn), or sawing for dimension lumber. The longitudinal segments of the present invention may utilize wood sawn from any of these patterns. Longitudinal segments using wood sawn for radial grain may reduce potential distortions due to shrinkage and swelling, however, wood used for the longitudinal segments may be dried and sorted to avoid cut boards that have twists, bows, cups or crooks. By eliminating these boards at the sorting phase, the longitudinal segments are more likely to remain stable when utilized in the log assemblies of the present invention.

A user may use the log assemblies to side the exterior or interior walls to simulate a solid log wall construction. The log assemblies may have varying arcs and circumferences and may be staggered throughout the construction to further simulate the non-uniform look of solid debarked logs. Those skilled in the art will appreciate that it may be desired to utilize high content bio-based insulation. The longitudinal segments are thick enough so that the bio based materials does not penetrate to the wood cell structures near the external surface to be stained or varnished.

Turning attention now to the Figures, embodiments of the log facing assembly or log system 10 of the present invention will now be described in more detail. Referring first to the log assembly 10 generally shown in FIG. 1, the log assembly includes first, second, and third longitudinal segments, 12, 14, and 16 respectively, longitudinal shim segment 30, backing 34, and insulation 36. The first longitudinal segment includes a first tongue 60 that couples or mates with groove 62 formed in backing 34 and a groove 64 that couples with a tongue 66 formed in the second longitudinal segment 14. The second longitudinal segment 14 includes a groove 68 that couples with tongue 70 formed in the third longitudinal segment 16. The third longitudinal segment 16 includes a second groove 72 that couples with tongue 74 extending from shim 30. Shim 30 includes a second tongue 76 that couples with a second groove 78 formed in the backing 34. The backing 34 also includes tongue 86 and groove 82 that couple with similar mating backing tongue 80 and grooves of additional log assemblies. Tongue and grooves 60-82 may be replaced with other suitable gapless joints to couple the various segments together, however the joint or tongue and groove configuration shown in FIGS. 1 and 2 are the current preferred joint of the present invention which has been found to create a sturdy joint.

Figure 2:
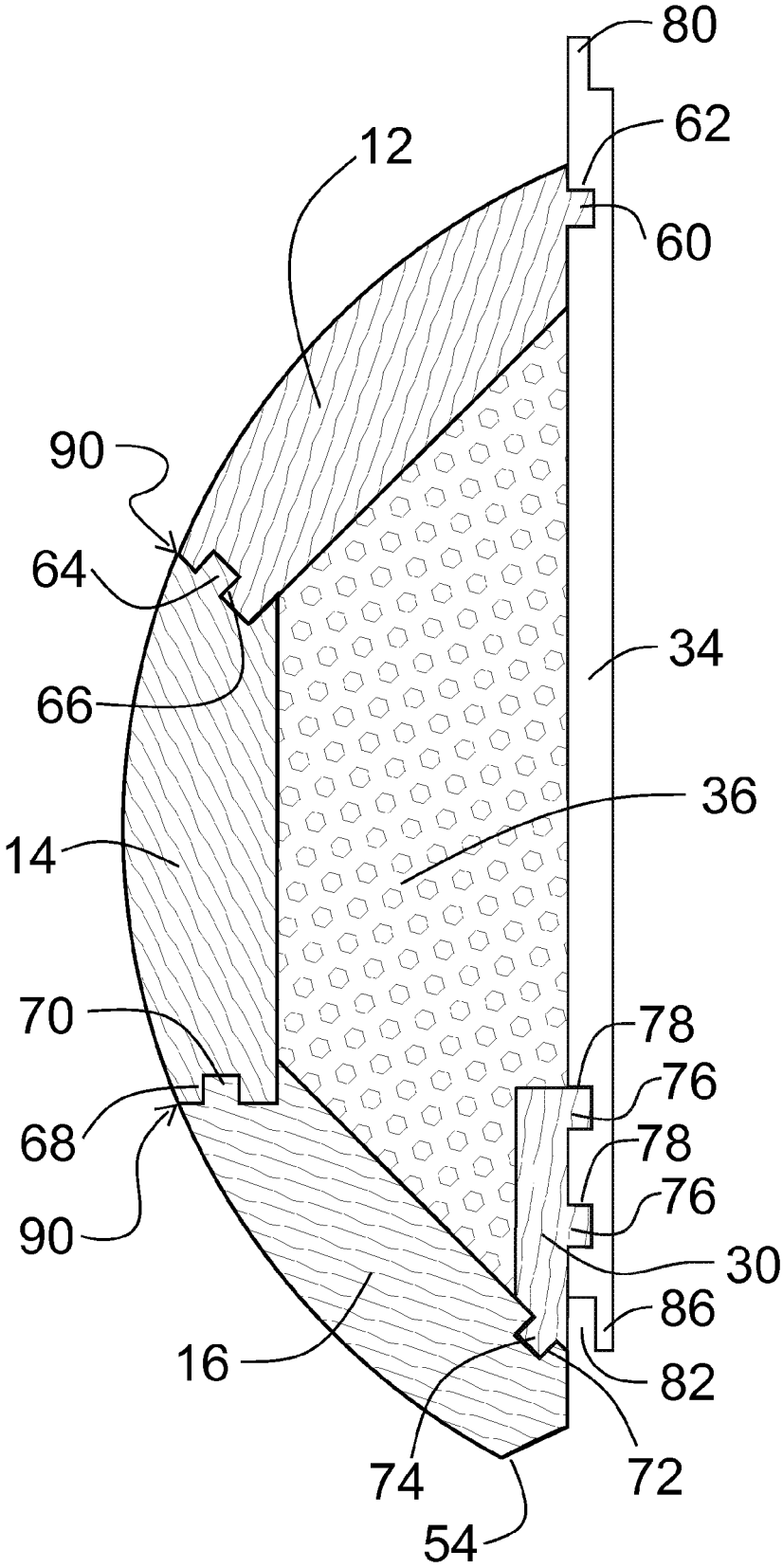
FIG. 2 is an end view of a log facing member in accordance with an embodiment of the invention.
Figure 3:
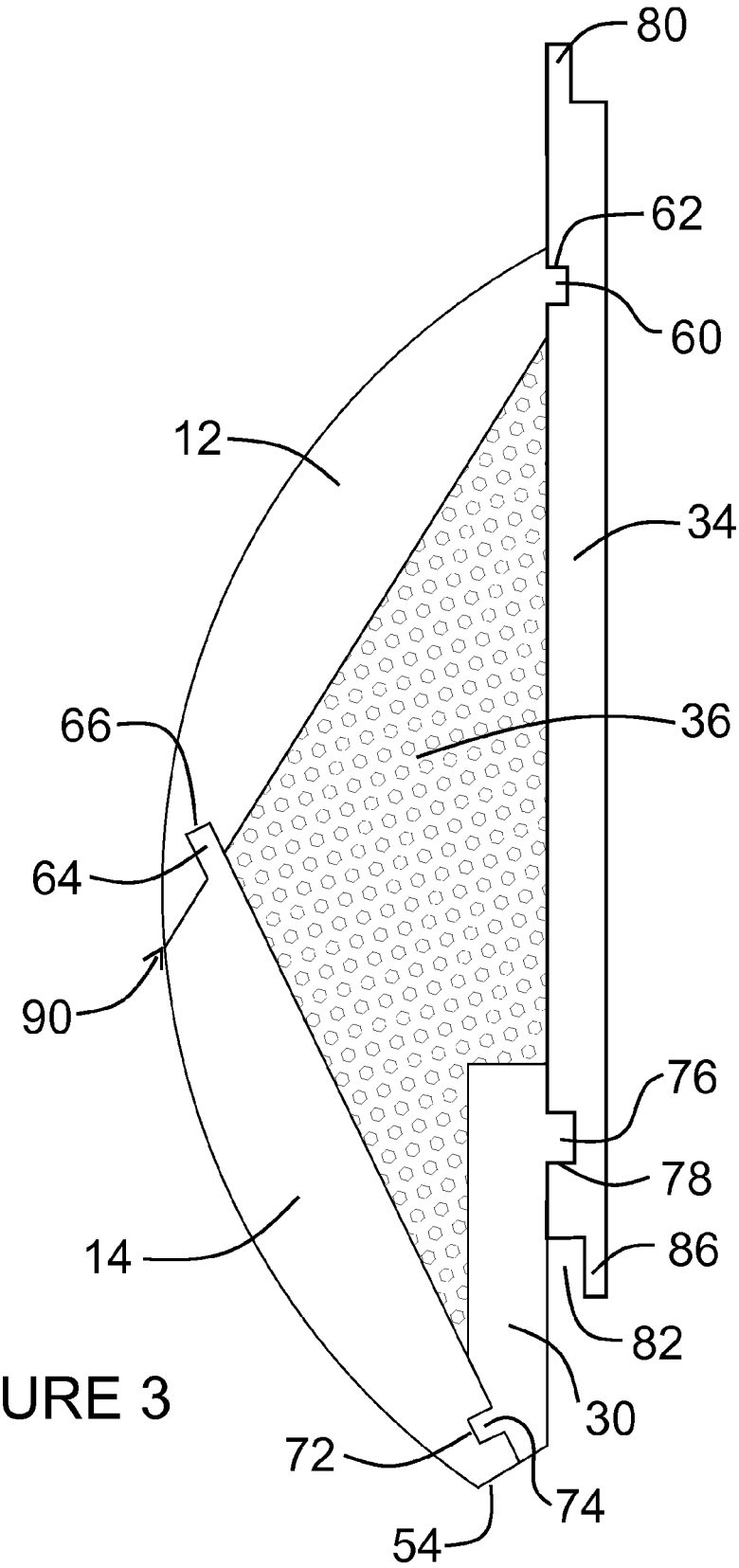
FIG. 3 is an end view of a log facing member in accordance with an embodiment of the invention.
Figure 4:
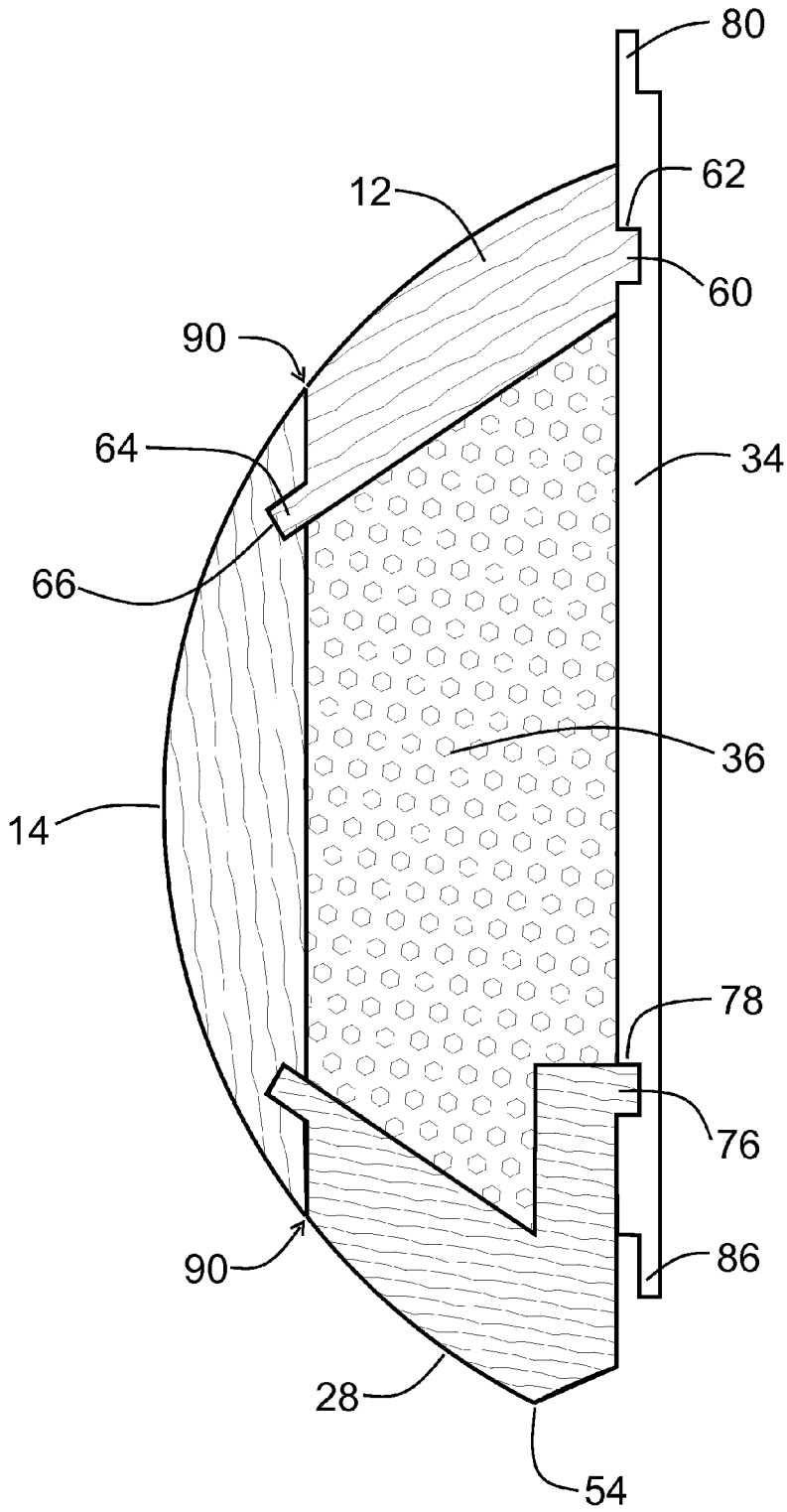
FIG. 4 is an end view of a log facing member in accordance with an embodiment of the invention.
Figure 5:
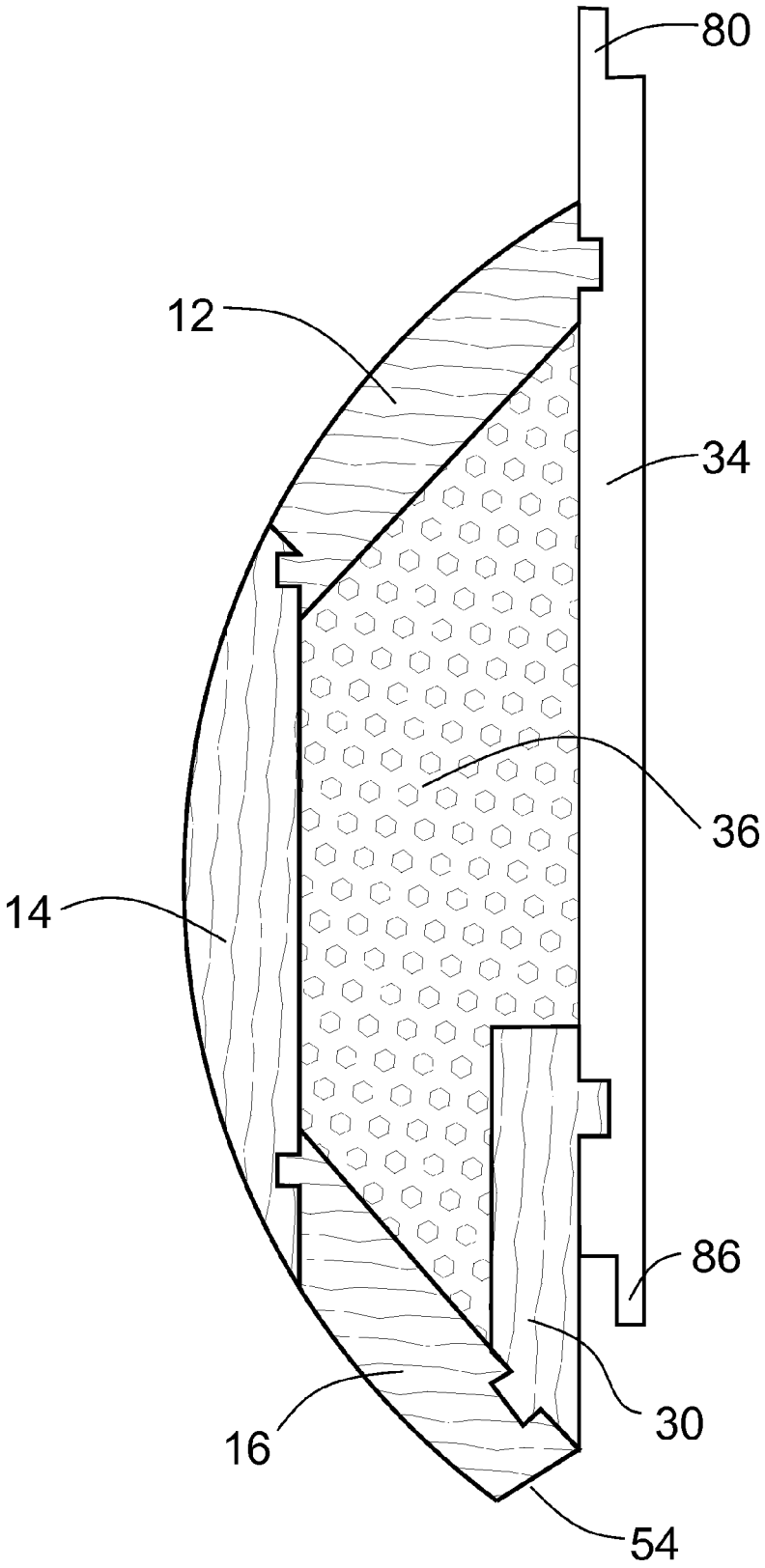
FIG. 5 is an end view of a log facing member in accordance with an embodiment of the invention.

As shown in FIG. 2, a drip edge 54 is formed in the third segment 16 and shim segment 30. When multiple log assemblies 10 are stacked together, the drip edge 54 of a top log assembly engages with an outer surface of a top longitudinal segment 12 of a lower log assembly. FIG. 3 illustrates that the tongue and groove joints may be modified and the third segment 16 eliminated. The width and thickness of the first and second segments 12 and 14 may be increased to keep the dimension of the arc formed by these segments similar to the arc formed by a three segment assembly. Alternatively the width and thickness may be kept the same or reduced to create an arc with a reduced dimension and to simulate varying log diameters. A sealant or silicone, for example, may be applied to joint 90 between segments and between the drip edge 54 and outer surface of the top segment to further direct moisture away from the joint or seam. FIG. 4 illustrates that a lower third segment 16 and shim 30 may be integrated to form a combined lower segment and shim 28. FIG. 5 further illustrates that the thickness of each segment 12, 14, and 16 may be varied without changing the external arc dimension. Thinner segments may reduce the cost of materials for the assembly and may be particularly well suited for internal wall structures. The drip edge 54 is formed on a side edge of the third segment 16 and the joint between the third segment and shim 30 may be formed along the inner surface of the third segment 16. When the log assembly 10 illustrated in FIG. 5 is incorporated into an interior wall the insulation 36 may alternatively be excluded from the assembly.

Figure 6:
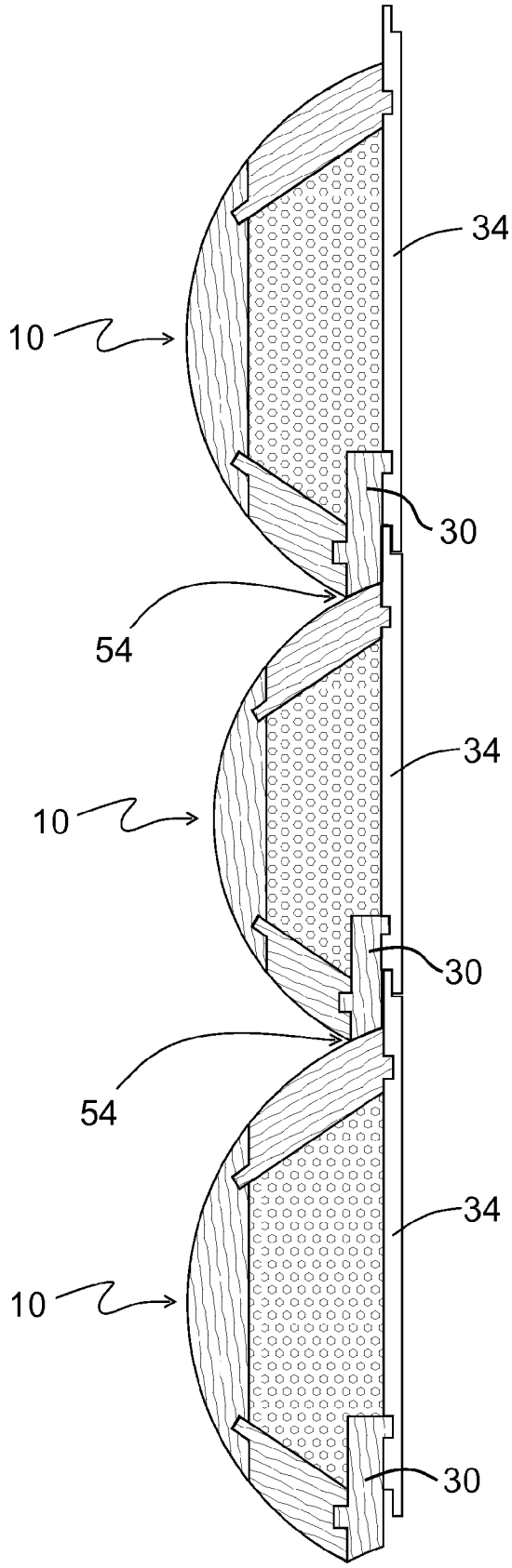
FIG. 6 is an end view of multiple stacked log assemblies having varying log profiles in accordance with an embodiment of the invention.
Figure 7:
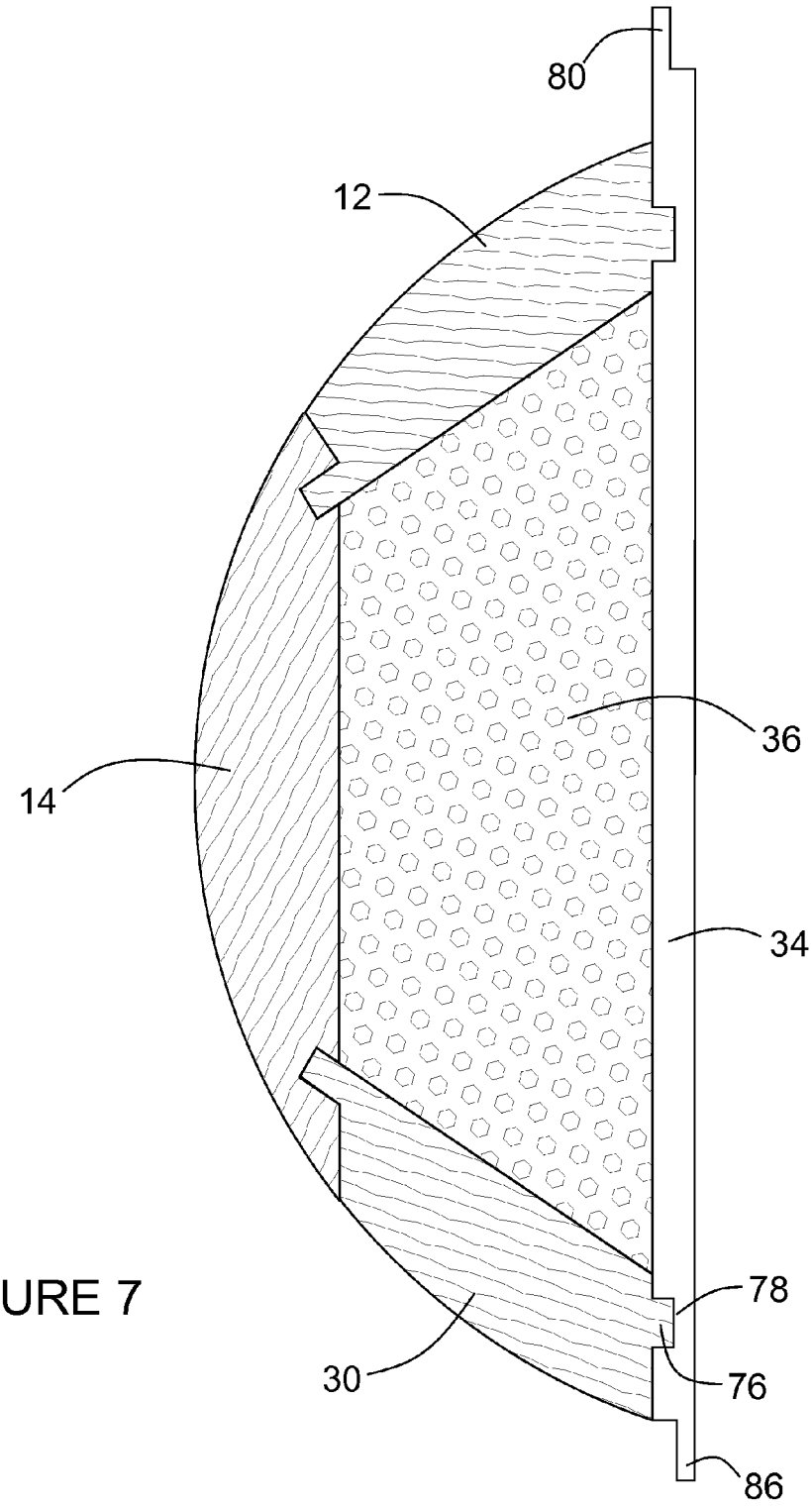
FIG. 7 is an end view of a log facing member in accordance with an embodiment of the invention.
Figure 8:
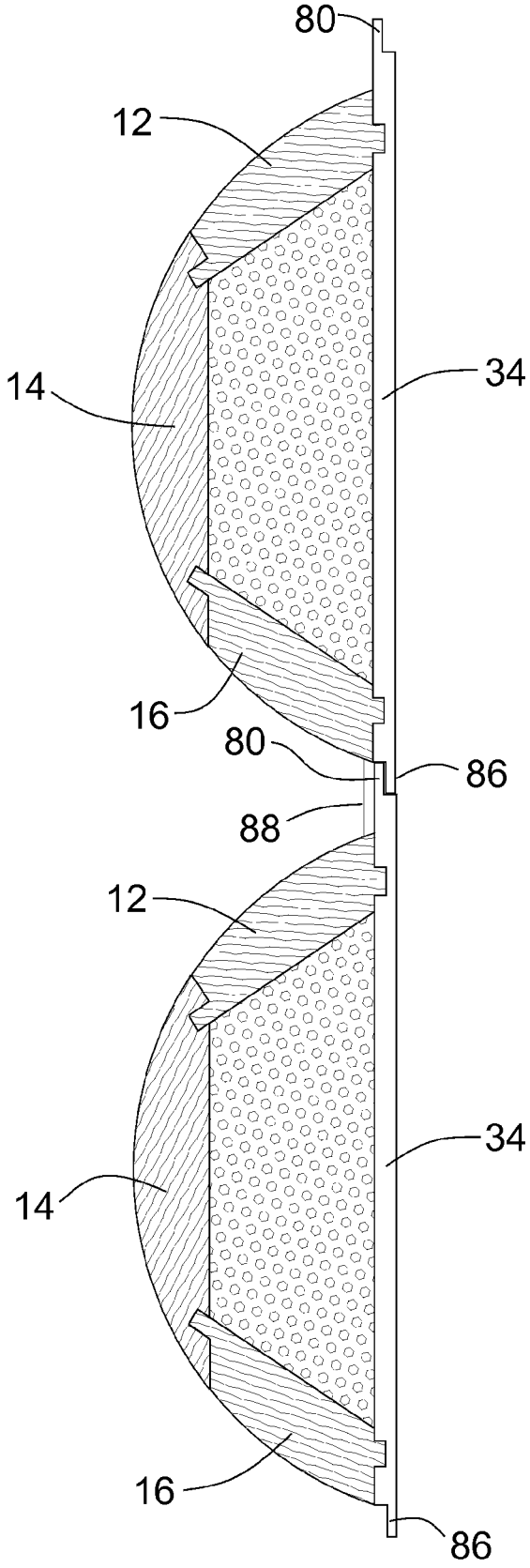
FIG. 8 is an end view of multiple stacked log facing members having a chinking strip separating the log facing members in accordance with an embodiment of the invention.
Figure 9:
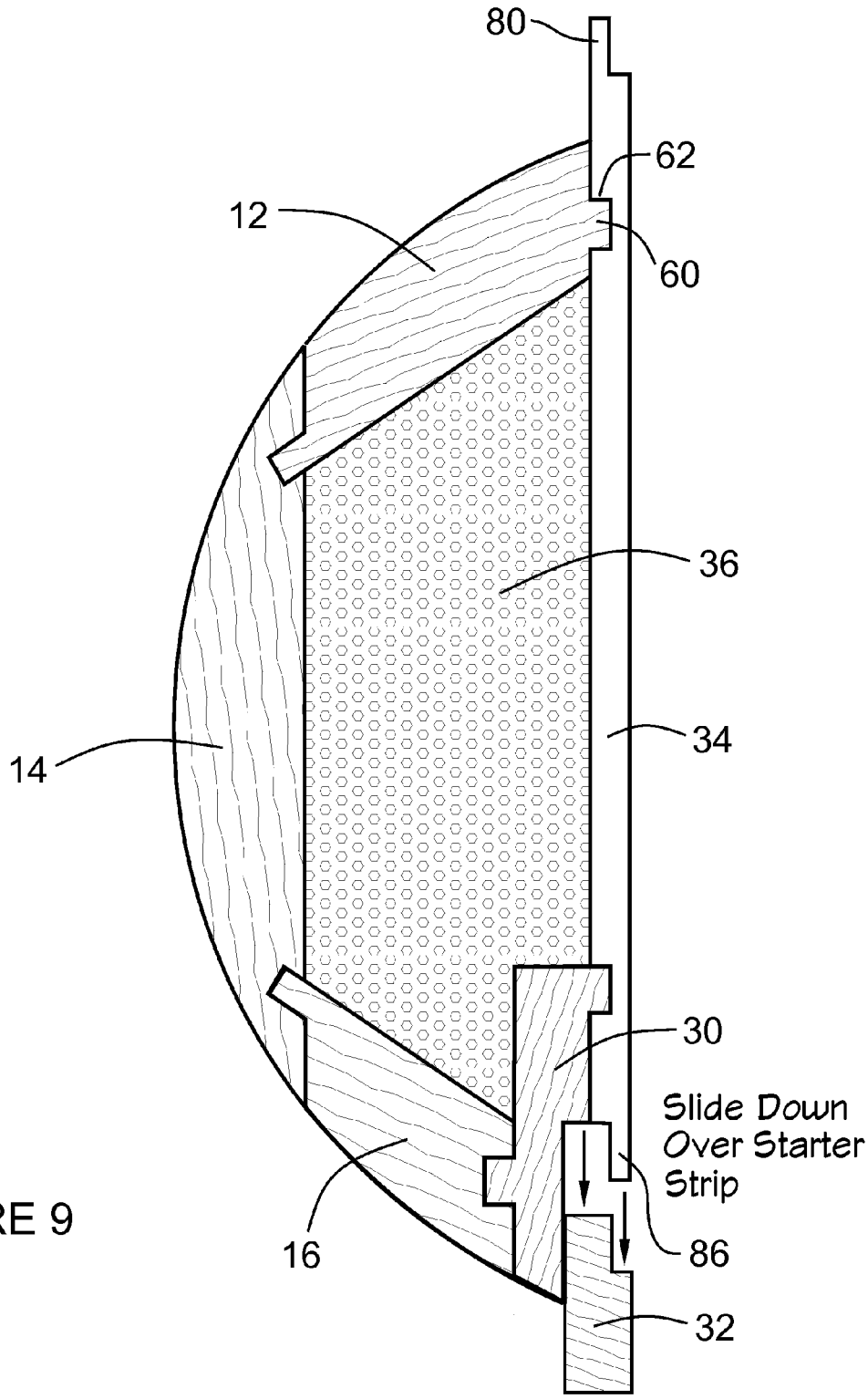
FIG. 9 is an end view of a log facing member in accordance with the present invention.
Figure 10:
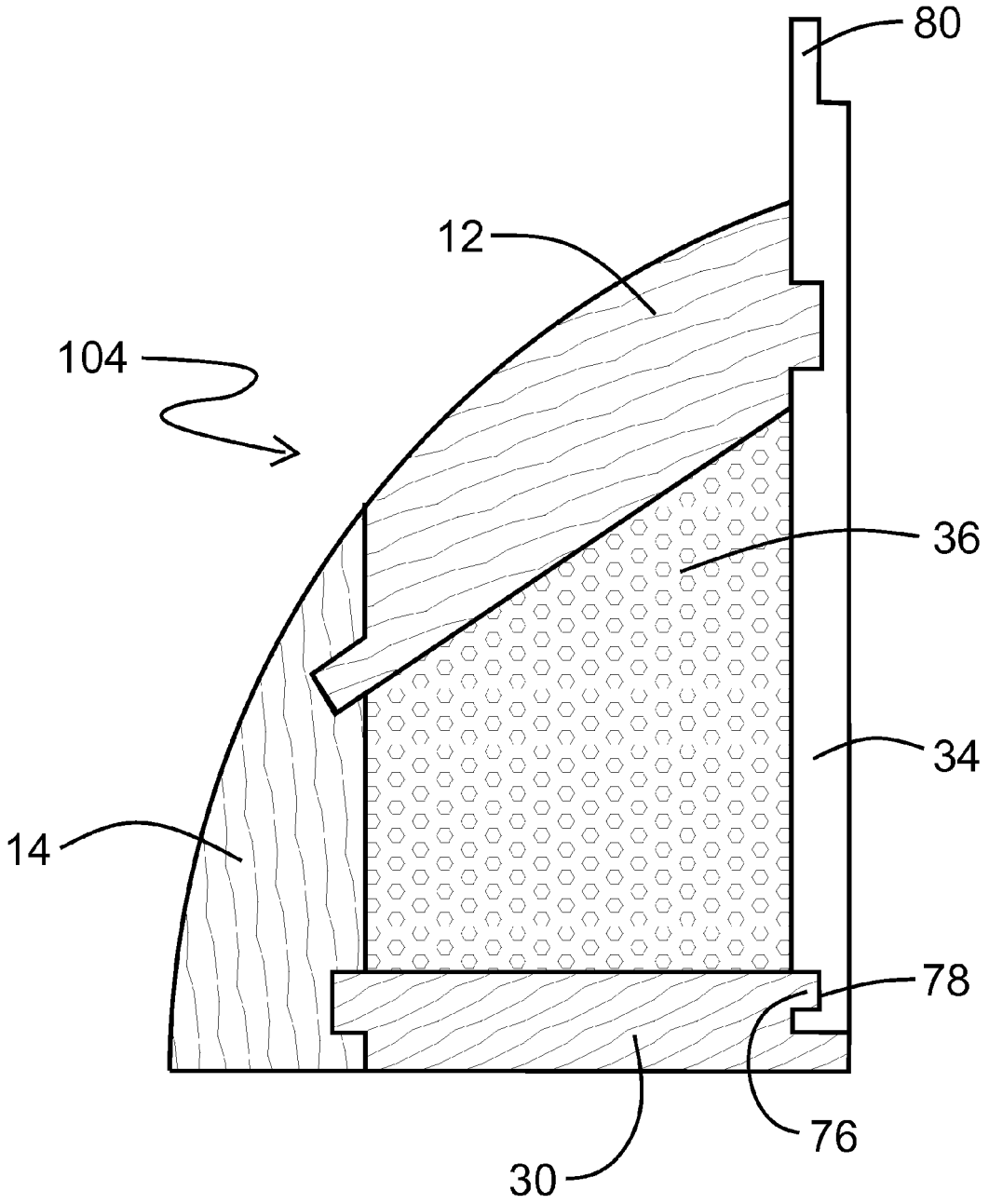
FIG. 10 is an end view of another log facing member in accordance with an embodiment of the invention.
Figure 11:
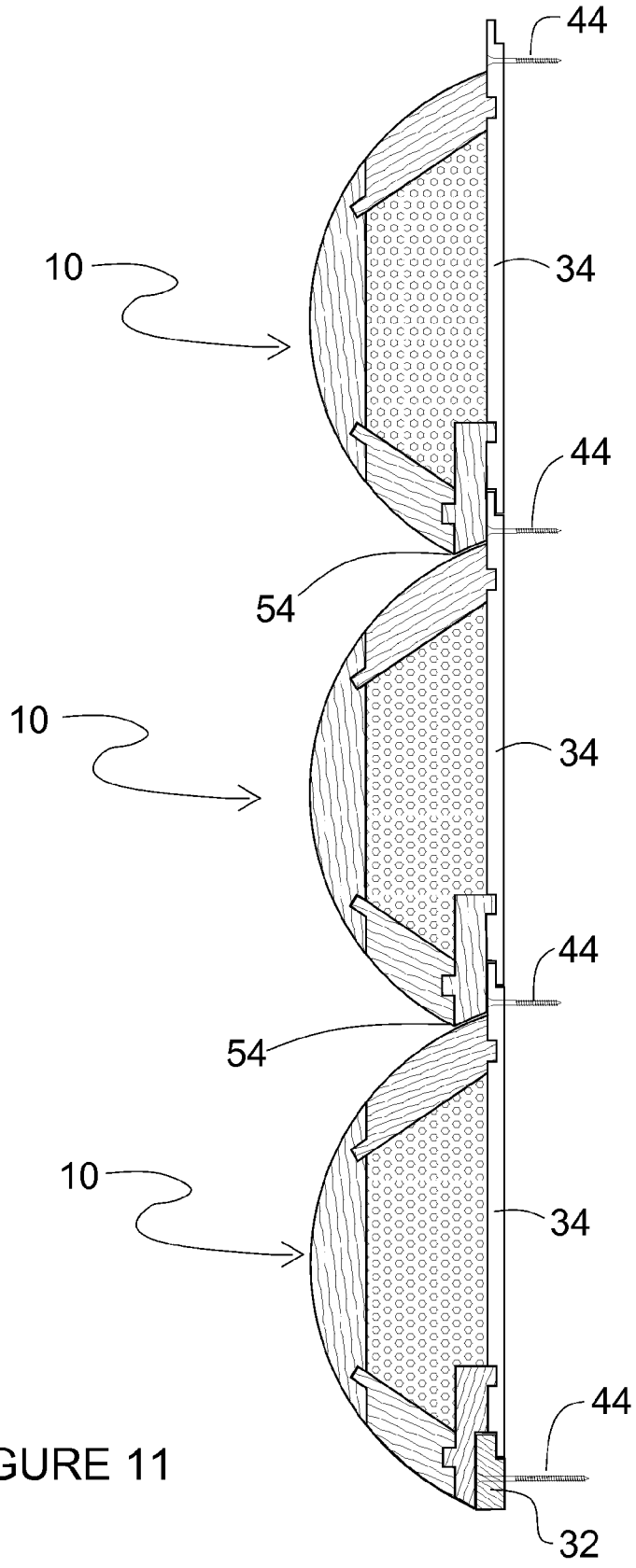
FIG. 11 is an end view of multiple stacked log assemblies in accordance with an embodiment of the invention.

Referring to FIG. 6 multiple log assemblies 10 are shown stacked together to form a panel that simulates a log wall. Shim 30 overlaps the first longitudinal segment of an adjacent assembly to provide a drip edge 54 that directs moisture out and away from the backing and wall. FIGS. 7 and 8 illustrate a log assembly 10 that when stacked together leaves a gap between the upper and lower log. The gap is filled with a chinking strip 88 to simulate chinking that is used to fill voids between two solid logs. The top and bottom edges of the chinking strip contact the upper and lower segments 12 and 16 to create a drip edge and direct water away from backing 34. A sealant may be applied to the chinking strip 88 and backing 34 to further restrict moisture from penetrating to the backing 34 or wall. Alternatively, a synthetic chink may replace chinking strip 88 to fill the gap between the upper and lower log. FIG. 10 illustrates a quarter log assembly 104 particularly well suited as a base or starter log at the foundation of a building. Alternatively, a half log facing assembly and strip 32 as shown in FIG. 9 may be utilized as a base or starter log at a foundation of a building. The shim 30 is modified in FIG. 9 to create a wider slot for starter strip 32 to engage. FIG. 11 further illustrates the use of strip 32 with the lower most log assembly positioned at the foundation of a building. Log assemblies 10 are stacked with the tongue and groove of the backing 34 coupling together to fix the assembly firmly against the wall. Fasteners 44 extend through an upper portion of backing 34 near tongue to further fix the assembly against the wall. As illustrated in FIG. 6, the dimensions of the longitudinal segments 10, 12, and 14 may be modified to vary the arcs of the assemblies 10 (the middle assembly has a smaller arc than the assembly above or below it).

Figure 12:
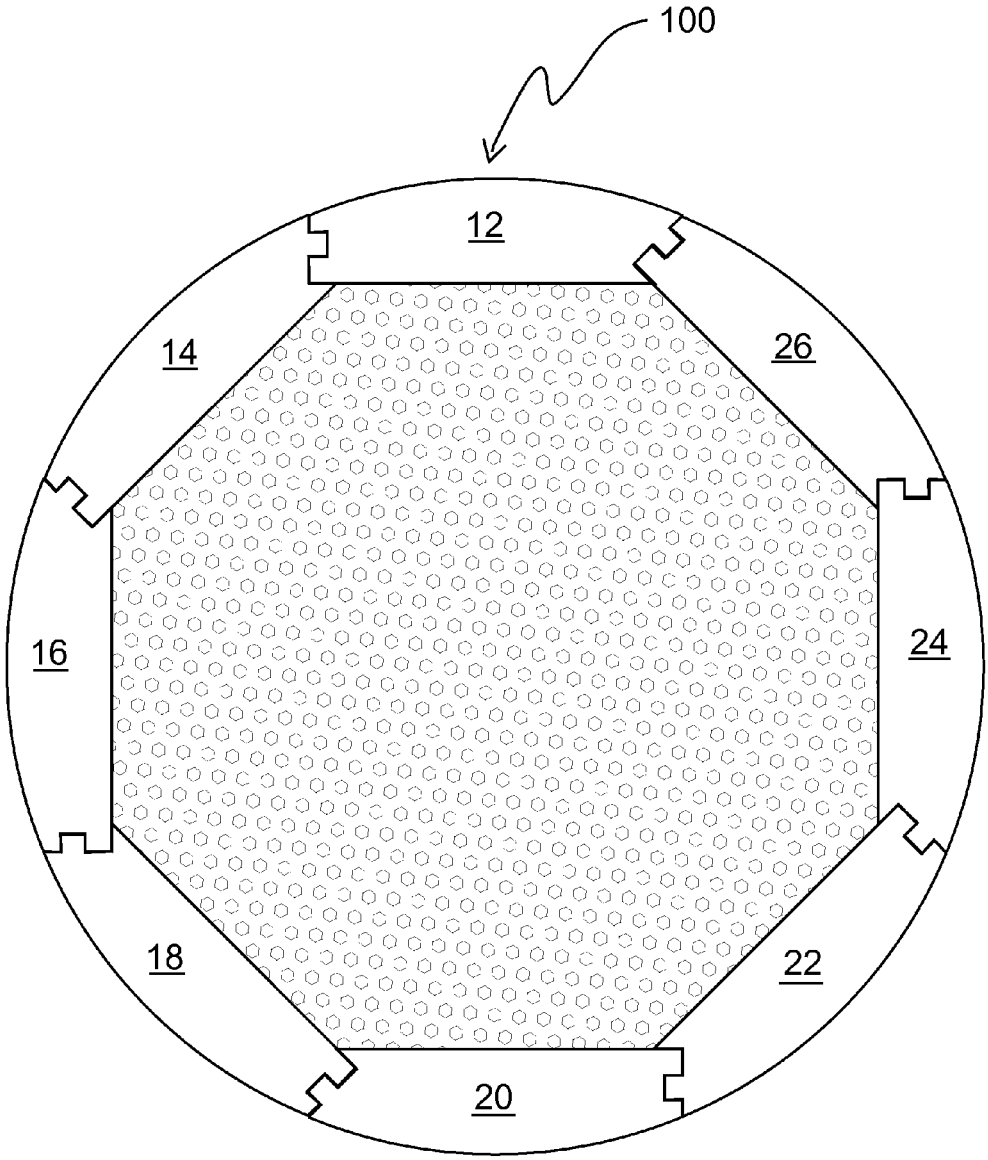
FIG. 12 is an end view of the log assembly in accordance with an embodiment of the invention.
Figure 13:
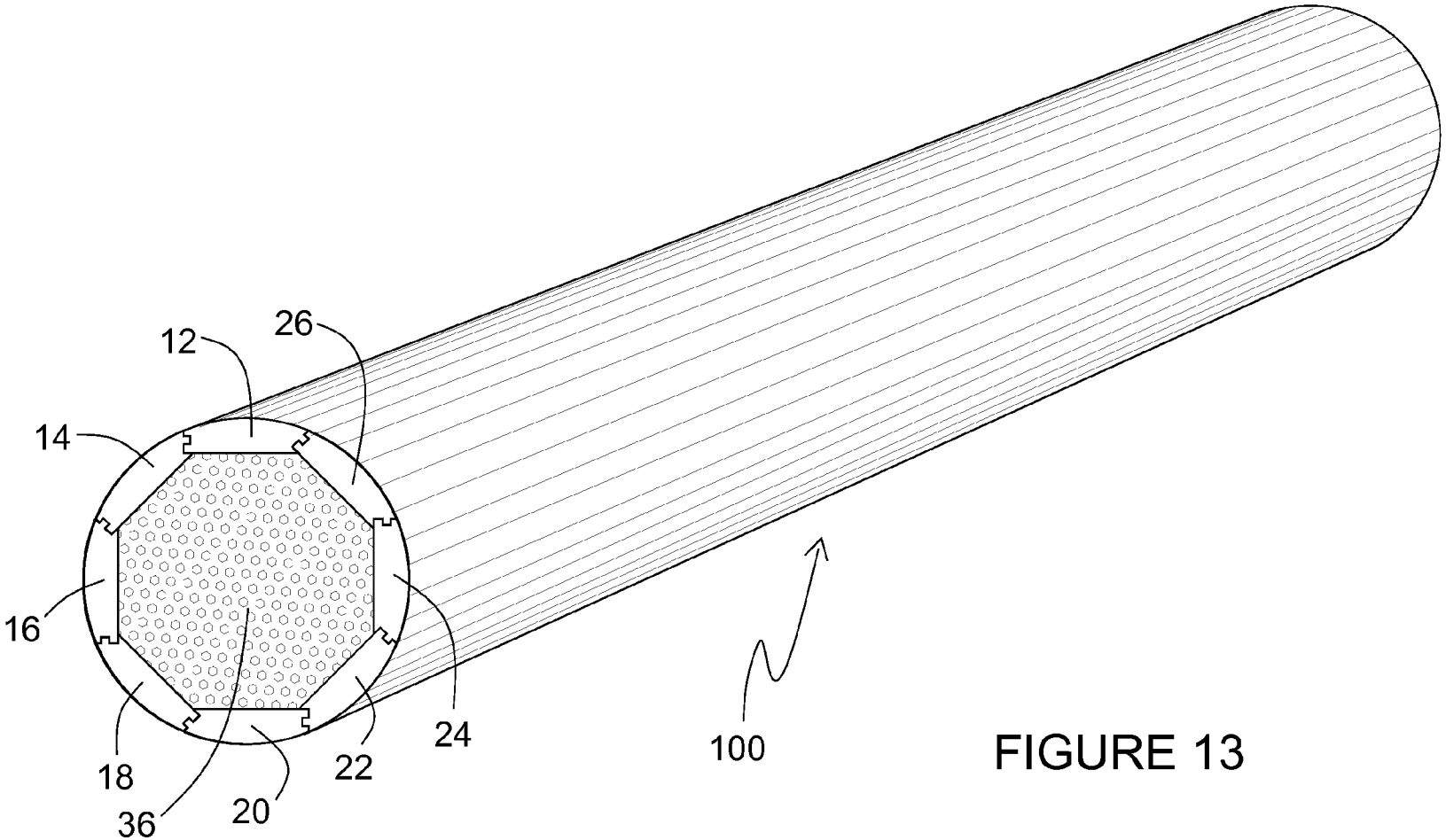
FIG. 13 is a perspective view of a log assembly of the type shown in FIG. 12 in accordance with an embodiment of the invention.
Figure 14:
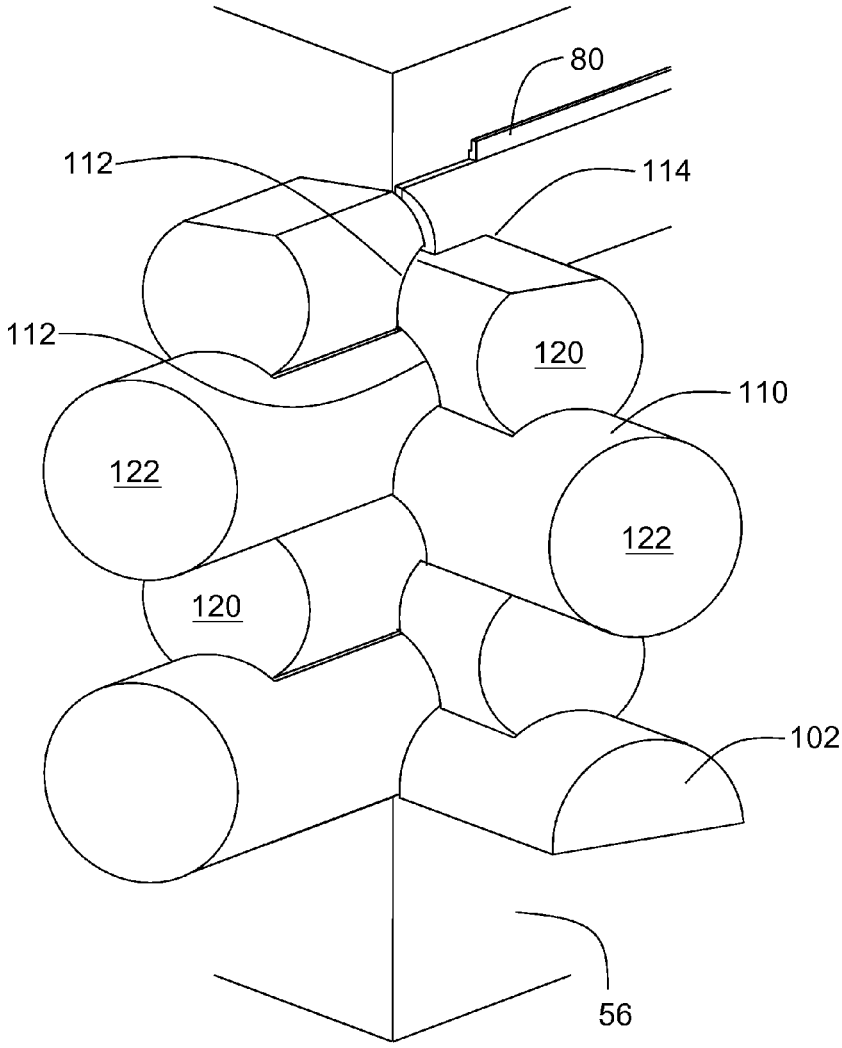
FIG. 14 is a partial perspective view of a corner log assembly in accordance with an embodiment of the invention.
Figure 15:
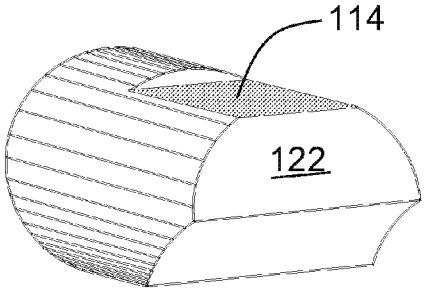
FIG. 15 is a partial sectional perspective view of a single corner log in accordance with an embodiment of the invention.
Figure 16:
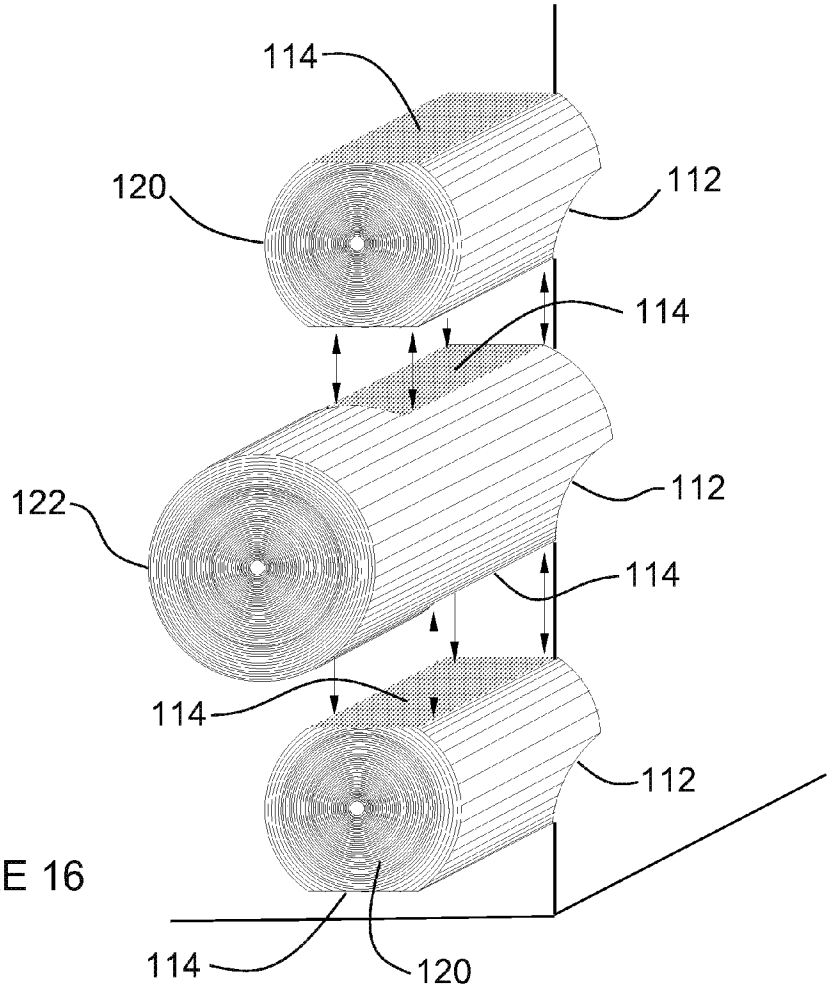
FIG. 16 is a partial sectional exploded view of a corner log assembly in accordance with an embodiment of the invention.
Figure 18:
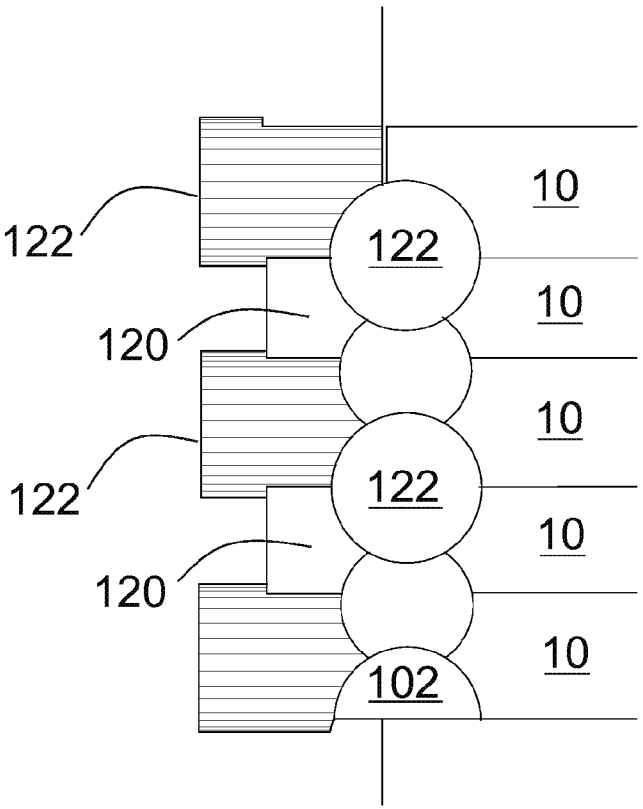
FIG. 18 is another partial side view of a corner log assembly in accordance with an embodiment of the invention.
Figure 17:
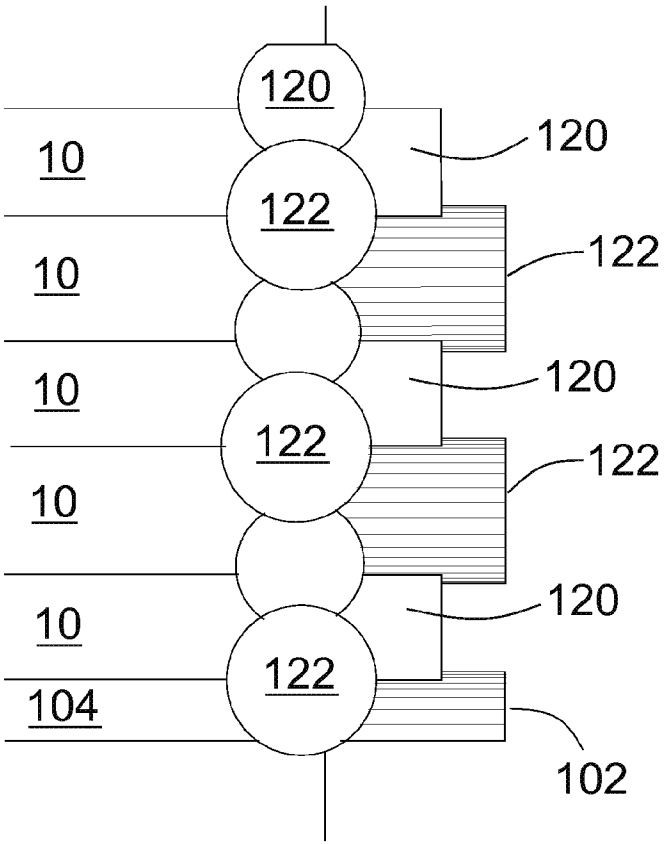
FIG. 17 is a partial side view of a corner log assembly in accordance with an embodiment of the invention.

With reference to FIGS. 12 and 13, first, second, third, fourth, fifth, sixth, seventh, and eighth longitudinal segments, 12-26 respectively, may be coupled together with the corresponding tongue and grooves of each segment to form a cylindrical log assembly 100. The external surface of the gapless cylindrical log assembly 100 may be further contoured to further resemble a debarked solid log. The circumference of the substantially cylindrical log assembly 100 may be increased or decreased by varying the width of the longitudinal segments 12-26. The ends of the log assembly 100 may include a cap engaged with an end of the longitudinal segments 12-26 to enclose the end (shown in FIGS. 14-18). Circular, concentric rings may be scribed into the cap to create an appearance of growth rings on the end of the log assembly. A high content bio-based insulation 36 (soy, for example, without limitation intended) is positioned within the enclosed inner portion of log assembly 100 to provide further rigidity and load bearing strength to the log assembly. Alternatively, a polyurethane based foam may be used as the insulation 36, however consumers may prefer a bio-based insulation.

The log assembly 100 may be cut into desired lengths to create interior or exterior exposed trusses (either bad bearing or aesthetic depending upon the application), or corner logs 110 (see FIGS. 10-16). Additionally, the log assembly 100 is particularly well suited for use as log beams, posts, purlins or outlookers. A tight fit in the tongue and groove or other coupling joint increases the amount of pressure or force that may be applied to the external surface of the log assembly without compromising the integrity of the log assembly. A polyurethane hot-melt structural adhesive may be applied to the tongue and groove joints to laminate the segments together, further increasing the amount of pressure or force that the log assembly may withstand.

Referring now to FIGS. 14-18 a saddle notch corner assembly of the present invention will next be described. In the field, when a user applies the log assembly facing 10 to a wall, the user typically starts from the bottom of the wall fastening a first strip 32 (as described with reference to FIG. 9) or quarter round log assembly 104 to the wall, and aligning it parallel with a top edge of the foundation. Traditional or solid log assemblies typically stack logs alternating from one intersecting wall to an adjacent intersecting wall, resulting in a staggered saddle notch corner at the corner intersection of two walls.

The log assembly of the present invention may be utilized to create a staggered saddle notch corner. Corner logs 110 may be constructed having two or more diameters and then stacked, alternating between a larger diameter 122 and smaller diameter 120 corner log 110. The ends of the corner log 110 include notches 112 that mate with the arcing surface of an adjacent but tangential corner log 110 and a flat or perpendicular end portion presses flush with the wall and mates with the end edge of a corresponding log assembly facing 10. Note that the user cuts a notch out of backing tongue 80 to march the flat end portion of a corresponding corner log 110 (see FIG. 14). In this manner the seams or butt joints between the log assembly facing 10 and the corner logs 110 are concealed by the overlapping and staggered corner logs 110 (see FIGS. 14, 17, and 18). A half round log assembly 102 may be positioned at the base of one corner and aligned with the sight line of a corresponding quarter round log assembly facing 104 (see FIG. 17).

The ends of the larger diameter 122 corner logs 110 may extend out past the ends of adjacent smaller diameter 120 corner logs to further create a staggered look. A flat surface 114 is formed on the upper and lower surface of the corner logs 110 to mate with adjoining upper or lower corner logs, creating a tight stack and further simulating the appearance of a staggered saddle notch corner (see FIGS. 14-16). A portion of an end of the corner log may be sawn to match the arc of an adjacent corner log. The smaller diameter corner logs 120 may have opposing arcs sawn in an end to match the upper and lower arcs of opposing logs (see FIG. 16). A thin layer of silicon or other seal may be applied to the flat surfaces to reduce potential water penetration to the wall corners.

Figure 19:
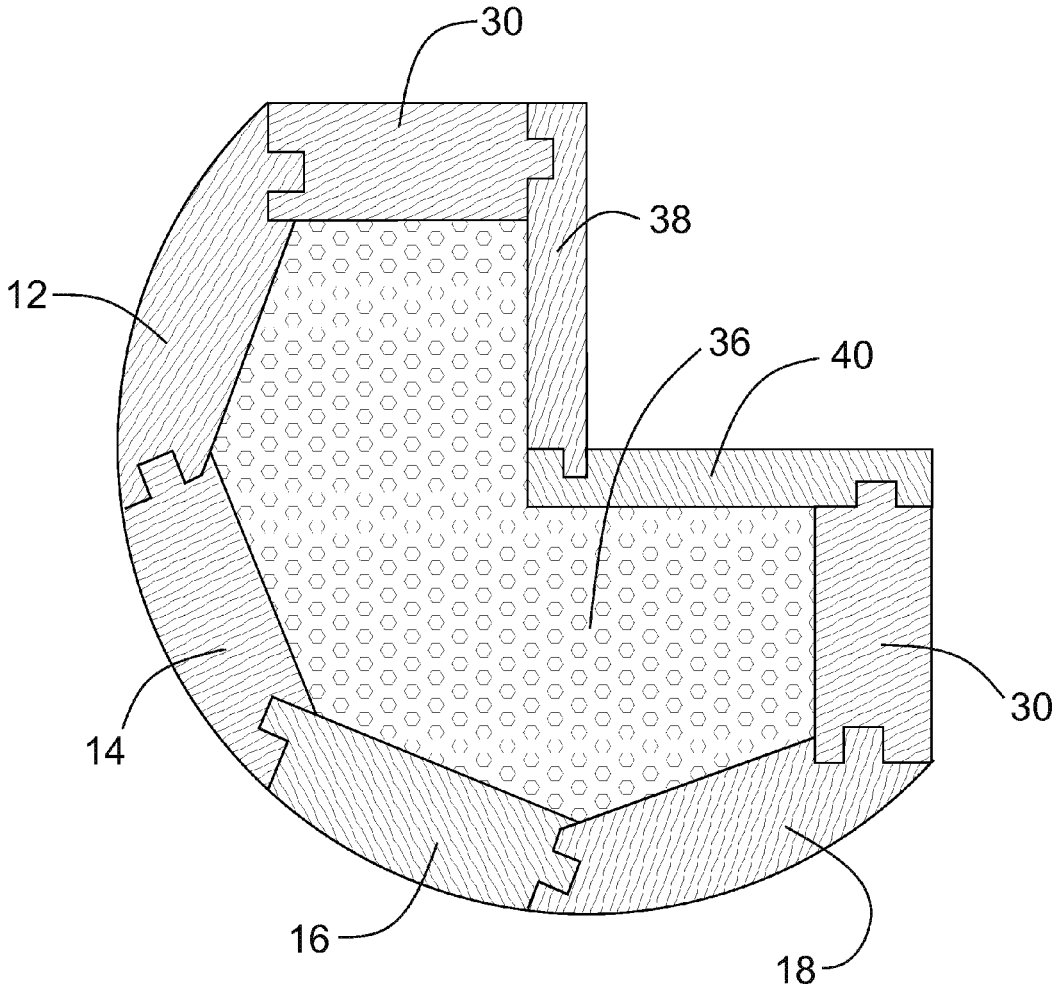
FIG. 19 is an end view of a log assembly in accordance with an embodiment of the invention.
Figure 20:
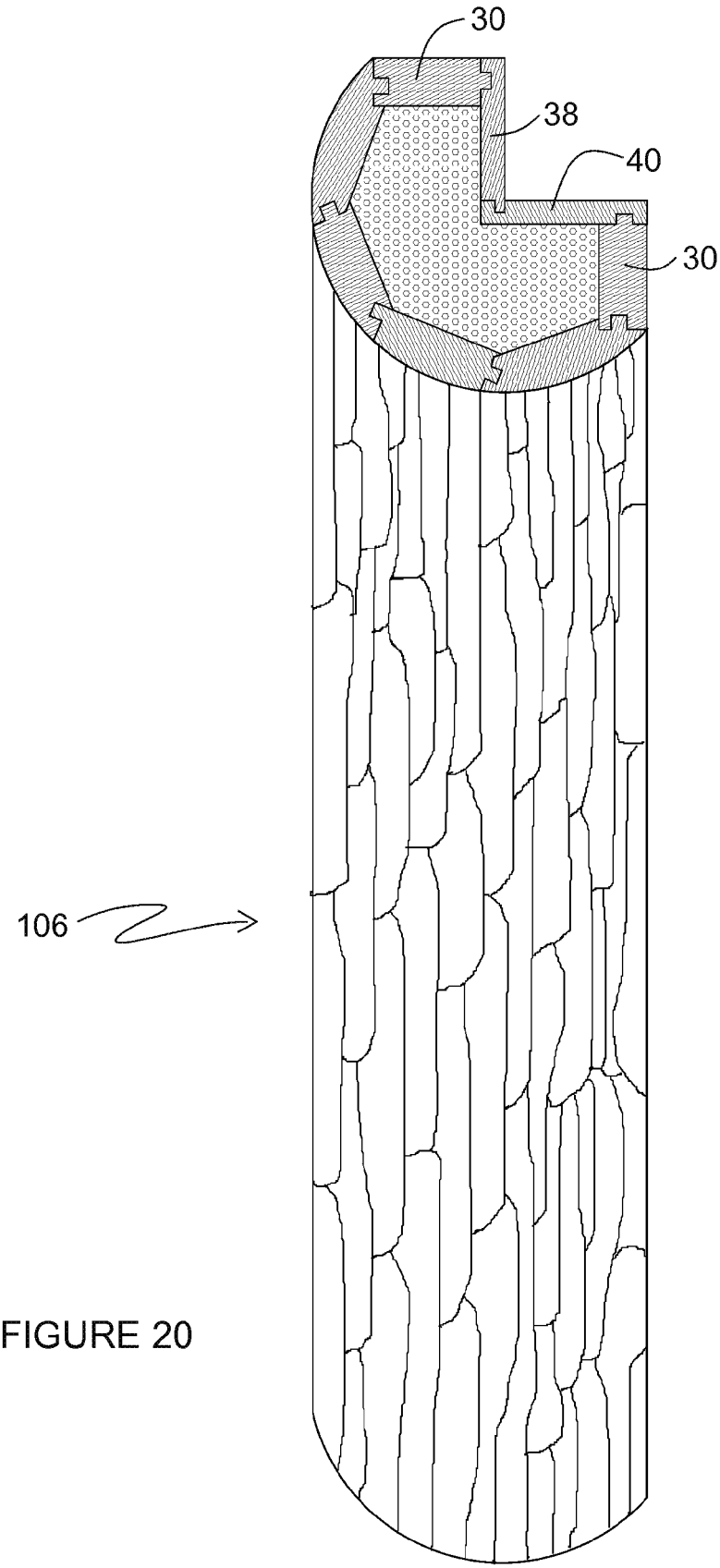
FIG. 20 is a perspective view of the log assembly of the type shown in FIG. 19.

Referring to FIGS. 19 and 20 an alternate log corner system of the present invention is shown. A three quarter round log assembly 106 includes first and second planar segments 38 and 40 that may engage with a corner of the wall. Ends of the log assembly facing 10 may be pressed flush against the outer surface of shims 30. Alternatively, the three quarter round log assembly 106 may be used as a corner post in other portions of the building construction.

These and various other aspects and features of the invention are described with the intent to be illustrative, and not restrictive. This invention has been described herein with detail in order to comply with the patent statutes and to provide those skilled in the art with information needed to apply the novel principles and to construct and use such specialized components as are required. It is to be understood, however, that the invention can be carried out by specifically different constructions, and that various modifications, both as to the construction and operating procedures, can be accomplished without departing from the scope of the invention. Further, in the appended claims, the transitional terms comprising and including are used in the open ended sense in that elements in addition to those enumerated may also be present. Other examples will be apparent to those of skill in the art upon reviewing this document.

What is claimed is:

1. A log facing assembly, for simulating a log wall construction comprising:

at least first, second and third longitudinal facing segments, wherein said second longitudinal facing segment is coupled between said first and third longitudinal facing segments; and a longitudinal backing segment, said longitudinal backing segment having a length approximating lengths of said first, second, and third longitudinal facing segments, wherein said first longitudinal facing segment further couples with said longitudinal backing segment.

2. A log facing assembly as recited in claim 1, further including a shim segment that couples with both said third longitudinal facing segment and said backing.

3. A log facing assembly as recited in claim 2, wherein a combination of outwardly facing surfaces of said first, second and third longitudinal facing segments create an arching surface.

4. A log facing assembly as recited in claim 3, wherein an arc of said arching surface of said log facing assembly may be increased or decreased.

5. A log facing assembly as recited in claim 2, further including a strip segment that engages with said backing and said shim segment.

6. A log facing assembly as recited in claim 2, wherein said shim segment couples by tongue and groove joints.

7. A log facing assembly as recited in claim 1, wherein said second longitudinal facing segment couples by tongue and groove joints.

8. A log facing assembly as recited in claim 1, wherein said first longitudinal facing segment couples with said backing by tongue and groove joints.

9. A log facing assembly as recited in claim 1, wherein multiple facing assemblies are stacked together to form a non-load bearing facing panel for simulating a log wall construction.

10. A log facing assembly for simulating a log wall construction, comprising:

at least first and second facing segments;

a shim segment; and a backing, wherein said first facing segment couples with said backing; and wherein said shim segment couples with both said second facing segment and said backing.

11. A log facing assembly as recited in claim 10 wherein a combination of outwardly facing surfaces of said first and second segments create an arching surface.

12. A log facing assembly as recited in claim 11, wherein an arc of the arching surface may be varied by coupling additional facing segments.

13. A log facing assembly as recited in claim 11, further including insulation adjacent an inwardly facing surface of said first and second segments.

14. A log assembly, comprising a plurality of longitudinal segments simulating portions of a log, each segment having longitudinal opposing edges, wherein each longitudinal edge of each segment is coupled to at least one of an edge of an adjacent longitudinal segment or a longitudinal backing having a length approximating a length of said plurality of longitudinal segments, said plurality of segments coupled together to form a gapless external surface and a gapless enclosed inner portion.

15. A log assembly as recited in claim 14, wherein outwardly facing surfaces of said plurality of longitudinal segments create an arching surface.

16. A log assembly as recited in claim 14, wherein each longitudinal outer edge of the plurality of longitudinal segments is contiguous to an edge of another longitudinal segment.

17. A log assembly as recited in claim 14, wherein only said plurality of longitudinal segments together form a gapless cylindrical shape.

18. A log assembly as recited in claim 17, wherein a circumference of said substantially cylindrical shape may be increased or decreased.

19. A log assembly as recited in claim 17, further including insulation positioned within at least a portion of the enclosed inner portion.

20. A log assembly as recited in claim 17, further including a cap engaged with an end of said plurality of longitudinal segments to enclose the end of said plurality of longitudinal segments.

21. A log assembly as recited in claim 20, further including a flat surface formed into an external surface of the substantially cylindrical shape.

22. A log assembly as recited in claim 14, wherein said plurality of longitudinal segments together form approximately three quarters of a substantially cylindrical shape.

* * * * *